United States Patent [19]

Lang

[11] 4,132,968

[45] Jan. 2, 1979

[54] CURRENT LIMITING CIRCUIT BREAKER WITH IMPROVED MAGNETIC DRIVE DEVICE

[75] Inventor: Walter W. Lang, South Beaver, Pa.

[73] Assignee: Westinghouse Electric Corp., Pittsburgh, Pa.

[21] Appl. No.: 830,947

[22] Filed: Sep. 6, 1977

[51] Int. Cl.[2] ..... H01H 77/10

[52] U.S. Cl. ..... 335/16; 335/195

[58] Field of Search ..... 335/16, 147, 170, 174, 335/195

[56] References Cited

U.S. PATENT DOCUMENTS

| | | | |
|---|---|---|---|
| 3,991,391 | 11/1976 | Wafer | 335/16 |
| 4,039,983 | 8/1977 | Tenracol et al. | 335/16 |
| 4,071,836 | 1/1978 | Cook et al. | 335/16 X |

*Primary Examiner*—George Harris

*Attorney, Agent, or Firm*—Robert E. Converse, Jr.

[57] ABSTRACT

A current limiting circuit breaker comprises an improved slot motor magnetic drive device. The threshold level of overload current which produces current limiting action is raised, yet the degree of current limiting action during high overload currents is maintained by placing a thin saturable magnetic steel plate across the open end of the slot motor magnetic drive device. During overcurrent conditions below the threshold value, the plate shunts most of the magnetic flux and prevents production of magnetodynamic force upon the contact arm. Above the threshold level, the overcurrent generates magnetic flux sufficient to saturate the plate and forces additional flux into the air gap where the flux interacts with the contact arm to drive the contact arm into the slot and produce current limiting action in a normal manner.

4 Claims, 3 Drawing Figures

CURRENT LIMITING CIRCUIT BREAKER WITH IMPROVED MAGNETIC DRIVE DEVICE

BACKGROUND OF THE INVENTION

1. Field of the Invention

The invention relates generally to circuit interrupters and, more particularly, to circuit breakers having magnetic drive devices to rapidly separate the contacts under high overcurrent conditions and produce current limiting action.

2. Description of the Prior Art

Current limiting circuit interrupters provide protection for electric power circuits by limiting the fault current downstream from the interrupter to a value less than the maximum fault current available from the source supplying power to circuit. It is known in the art to provide current limiting action by rapidly separating the contacts of the interrupter during fault conditions to quickly produce a high arc voltage across the contacts and oppose the flow of fault current. An example of a device operating in the manner is described in U.S. Pat. No. 3,991,391 (Class 335/16) issued Nov. 9, 1976 to John A. Wafer and assigned to the assignee of the present invention. Normal low-to-moderate overload current protection is provided by associated thermal and magnetic tripping circuit breakers, or an integral thermal and magnetic tripping capability may be provided.

One method of producing rapid contact separation employs a slotted magnetic drive device comprising an open-ended slot within which is disposed a movable contact arm. The contact arm is movable between a first position at the open end of the slot wherein the contacts permit current to flow therebetween, and a second position at the closed end of the slot which interrupts the flow of current through the contacts. During high overload current conditions, the current flow through the contact arm generates magnetic flux in the slotted magnetic drive device. The flux across the air gap at the open end of the slot interacts with current flowing in the contact arm to rapidly drive the contact arm from the open end of the slot to the closed end. The amount of force exerted on the contact arm (and, correspondingly, the degree of current limiting action) increases as the width of the slot decreases. However, for higher ratings, the slot width must be increased to raise the threshold of current limiting action above the upper setting of the magnetic trip function of the circuit protection equipment. If this is not done, an overload current at, or slightly above, the threshold level will cause the contacts to slightly separate but will not supply sufficient energy to activate the thermal or magnetic trip. Thus, current would continue to flow but at a level below the threshold. The contacts would then return into engagement with each other, at which time they would slightly separate once again, continuing in this manner to produce a "chattering" action. It would be desirable to provide a current limiting circuit interrupter which raises the threshold of current limiting action to prevent chattering but maintains a narrow slot width to produce effective current limiting action.

SUMMARY OF THE INVENTION

In accordance with the preferred embodiment of the present invention, there is provided a current-limiting circuit interrupter having separable contacts supported within a housing and a slotted magnetic drive device mounted within the housing having a slot with an open end and a closed end. The circuit interrupter also includes an elongated movable contact arm supporting one of the contacts and supplying current thereto, the contact arm being transversely disposed in the slot so that current flow through the contact arm is in a direction perpendicular to a line connecting the open and closed slot ends. The contact arm is movable between a first position at the open end of the slot which permits current flow through the contacts and a second position at the closed end of the slot which interrupts current flow through the contacts.

Extreme overcurrent conditions through the contacts generate magnetic flux in the magnetic drive device across the open end of the slot which interacts with current flow through the contact arm to produce a magneto-dynamic force driving the contact arm from the first position to the second position.

The magnetic drive device includes a saturable magnetic member bridging the open end of the slot and shunting magnetic flux produced across the open end of the slot. The plate saturates at a predetermined overcurrent value to raise the current limiting threshold to that predetermined value. At higher overload current levels, the flux is forced back into the air gap across the open end of the slot and interacts with the current flow through the contact arm to produce current limiting action in the normal manner.

DESCRIPTION OF THE PREFERRED EMBODIMENTS

Figure 1:
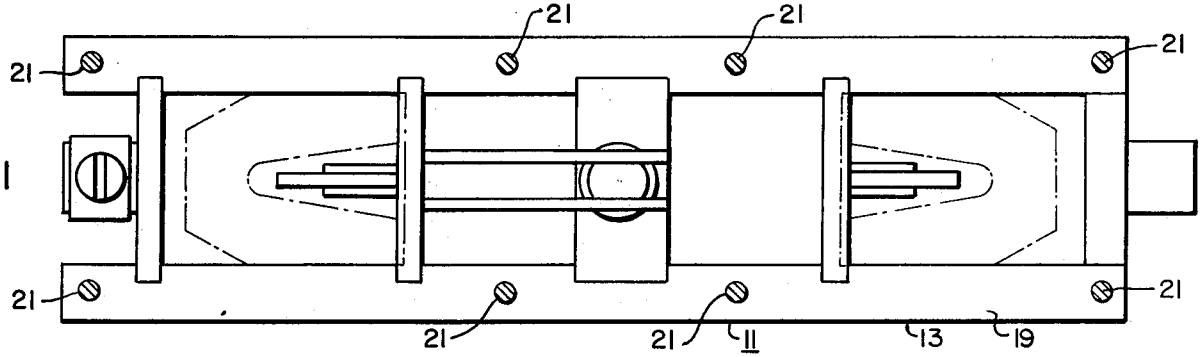
FIG. 1 is a top plan view of a circuit interrupter constructed in accordance with the principles of this invention.
Figure 2:
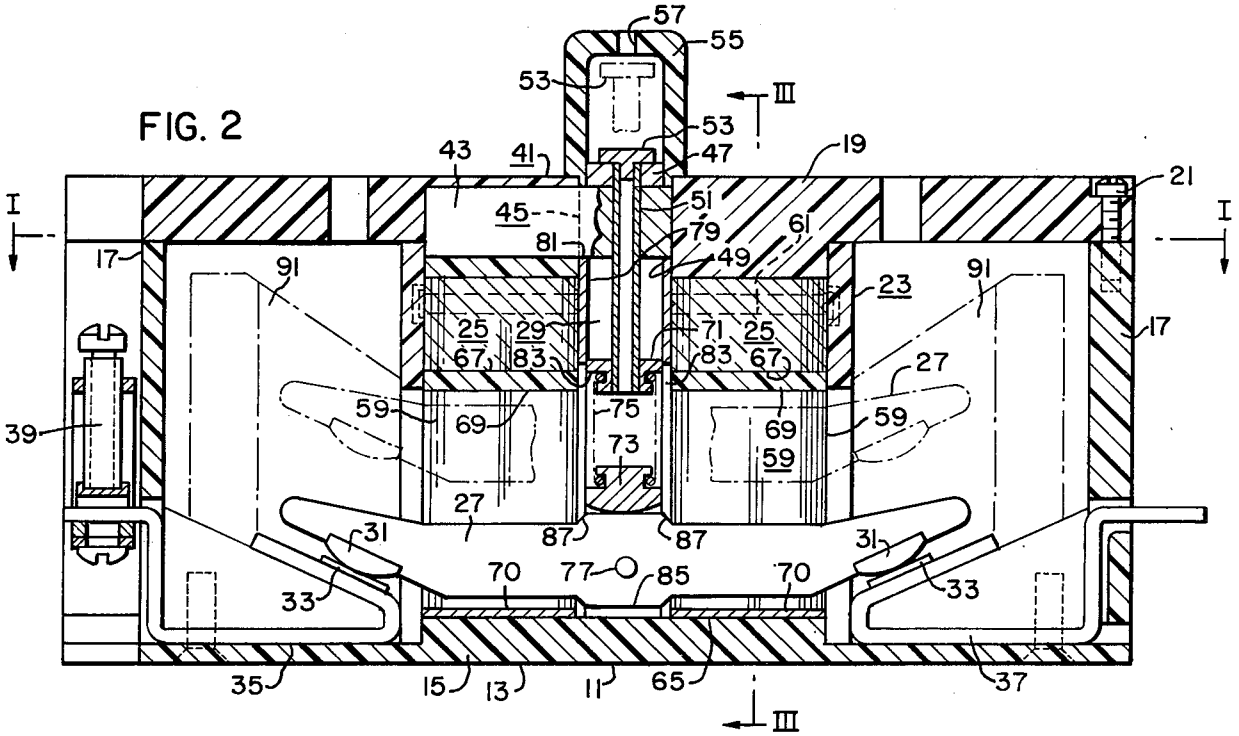
FIG. 2 is a vertical sectional view taken along the line II—II of FIG. 1.

In FIGS. 1 and 2, a circuit interrupter protective device similar to that described in the aforementioned U.S. Pat. No. 3,991,391 is generally indicated at 11. Although the device 11 is disclosed as a single pole circuit interrupting device, it is understood that it may be used for a plurality of poles such as a three pole unit. More particularly, the device 11 is a magnetic-drive circuit interrupter connected in electrical series with load and line leads of an electrical distribution system. A standard non-current limiting circuit breaker having thermal and magnetic tripping capability may be connected in series with and downstream from the illustrated device to provide protection for low to moderate overload currents. The device 11 comprises an insulating housing 13 which includes a base 15, sidewalls 17, and a cover 19. The several parts of the housing are secured together by a plurality of screws, such as screws 21, between the cover 19 and the sidewalls 17.

A magnetic drive circuit interrupter generally indicated at 23 is located substantially centrally of the housing 13 and comprises a magnetic drive device or magnetic slot motor 25, a contact arm 27, support means 29 for the contact arm, a pair of movable contacts 31, and stationary contacts 33. The stationary contacts 33 are mounted on spaced conductors 35 and 37, the outer ends of which extend through openings in the sidewalls 17 at opposite ends of the device 11. A connector for connecting the device 11 to line and lead conductors (not shown) may be provided on the outer ends of the contacts 35 and 37, such as the terminal conductor 39, on the outer end of the conductor 35. Accordingly, a circuit through the device 11 extends from the terminal 39 through the conductor 35, the stationary contact 33, the movable contact 31, the contact arm 27, the movable contact 31, and the stationary contact 33 to the conductor 37.

In addition, the magnetic drive circuit interrupter 23 includes a latch structure generally indicated at 41 and located at the upper end of the support means 29.

The latch structure 41 comprises a permanent magnet 43, a pair of pole pieces 45 (only one of which is shown in FIG. 2), and a keeper 47. The pole pieces 45 are disposed on opposite sides of the magnet and extend across a vertical opening 49 within a magnetic device 25 and the cover 19. The pole pieces 45 are disposed on opposite sides of a shaft or tube 51 which is part of the support means 29. The upper end of the shaft 51 has a cap 53 which is enclosed within a cylindrical portion 55 of the housing to prevent inadvertent contact with the cap. The housing portion 55 is sufficiently high to enable the shaft 51 to rise when the device 11 is in the open circuit position, as shown by the broken line position of the contact arm 27 in FIG. 2. In order to lower the contact arm 27 to the closed circuit position an opening 57 is provided on the upper side of the housing portion 55, whereby an appropriate instrument may be inserted to depress the cap 53 and the shaft 51 to the lowermost positions.

Figure 3:
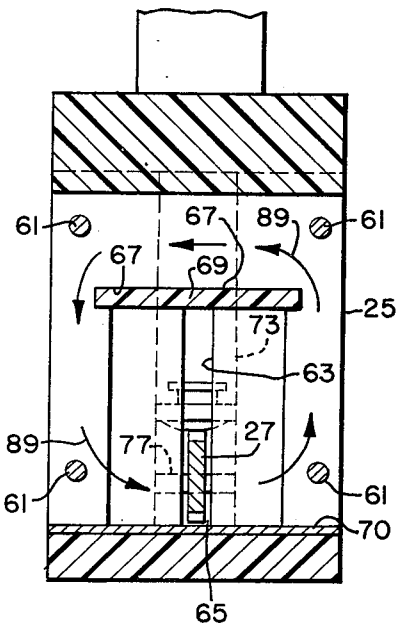
FIG. 3 is a vertical sectional view taken along the line III—III of FIG. 2.

The magnetic slot motor 25 is a rectangular body comprised of a plurality of laminations of relatively thin plates 59 of soft magnetic material, such as iron or cold rolled steel, that are secured together in a surface-to-surface relationship. The body of plates 59 is held together by a plurality of spaced means such as bolts 61 (FIG. 3). The magnetic slot motor 25 is a magnetic yoke formed of inverted U-shaped plates to provide a slot 63 (FIG. 3), the lower end of which is open at 65 and the upper end of which is closed at 67. Pads 69 composed of a resilient material, such as nylon, are mounted on the surfaces 67 to serve as bumpers for the contact arm 27 when it moves from the closed to the open circuit position as shown by the broken line position in FIG. 2. A thin saturable magnetic plate 70 of iron or cold rolled steel bridges the lower end 65.

The support means 29 comprise the shaft 51, a spring retainer 71, a shaft 73, a compression spring 75, and a pin 77. The central opening 49 includes a liner 79 of non-conducting material, such as the material known commercially as Teflon, which liner is coextensive with the vertical length of the opening; that is, from the open lower end 65 to a location 81 above the top surface of the magnetic slot motor 25. The liner 79 has a pair of diametrically opposite slots 83 which are aligned with the slot 63 to accommodate movement of the contact arm 27. The contact arm 27 is pivotally mounted on the shaft 73 by the pivot pin 77 to enable the contacts 31 and 33 to maintain good electrical contact for which purpose an opening 85, in which the contact arm is mounted in the shaft 73, is bevelled at 87 to allow for slight rotation of the contact arm. This insures that the contact arm 27 will contact on each side even though there is uneven wear of the contacts 31, 33. The device 11 also includes conventional arc chutes 91 around the contacts 31, 33.

The spring 75 is a compression spring which extends between the spring retainer 71 and the shaft 73, thereby holding the contact arm 27 tautly in the closed circuit position. It is understood, however, that the device would be operative if the shaft 51 were extended to a lower position where it would support the pivot pin 77 and thereby eliminate the need for the spring retainer 71, the shaft 73, and the spring 75. However, such a substitute construction would eliminate the advantage of the compression spring 75.

The latch structure 41 is the means by which the contact arm 27 is lowered and maintained in the closed circuit position with good electrical contact between the contacts 31 and 33. For that purpose, magnetic forces created by the permanent magnet 43 pass through the pole pieces 45 and across the keeper 47 when the contact arm 27 is in the lowermost or closed circuit position.

During periods of normal current condition, the current passing through the contact arm 27 creates an encircling magnetic field, indicated by the arrows 89 in the magnetic slot motor 25 (FIG. 3). The force of the encircling magnetic field during normal current condition is such that the arm 27 remains in the closed circuit position. Upon the occurrence of a severe overload above a predetermined value, the slot motor magnetic forces generated by the current in the contact arm 27 overcome the magnetic forces generated by the permanent magnet 43 and between the pole pieces 45 and the keeper 47. As a result, the increased magneto-dynamic forces in the magnetic slot motor 25 move the contact arm 27 upwardly within the slot 63, and thereby open the circuit through the contacts 31, 33. Due to the presence of the plate 70, however, the threshold level at which the slot motor forces become effective is raised. This is caused by the shunting effect of the plate 70 as it channels the magnetic flux out of the airgap and reduces interaction with current flow through the contact arm 27. At yet higher overload current levels the plate 70 saturates to force additional flux into the airgap and produce the previously described contact opening operation. In this manner, current limiting is achieved while at the same time reducing the "chattering" effect.

Various other alternate embodiments of the invention are contemplated. For example, current limiting circuit breakers employing conventional toggle mechanisms and thermal and magnetic trip devices in addition to the magnetic drive device could similarly be modified by the addition of a saturable magnetic member across the open end of the slot. In each case, the saturable member operates to raise the threshold at which current limiting action will occur to provide better control of the time-current tripping characteristic and eliminate the possibility of chattering.

It can be seen therefore that the present invention provides an improved current limiting circuit interrupter and that various other alternate embodiments may obtain the advantages of the present invention without departing from the spirit and the scope thereof.

I claim:

1. A current limiting circuit interrupter, comprising:
a housing;
separable contacts supported within said housing;
a slotted magnetic drive device mounted within said housing and having a slot with an open end and a closed end; and
an elongated movable contact arm supporting one of said contacts and supplying current thereto, said contact arm being transversely disposed in said slot so that current flow through said contact arm is in a direction generally perpendicular to a line connecting said open and closed slot ends, said contact arm being movable between a first position at said slot open end which permits current flow through said contacts and a second position at said slot closed end which interrupts current flow through said contacts, overcurrent conditions through said contacts generating magnetic flux in said magnetic drive device across said slot open end to generate an electro-dynamic force driving said contact arm from said first position to said second position;

said magnetic drive device comprising a saturable magnetic member bridging the open end of said slot and shunting magnetic flux produced across said slot open end, said magnetic member saturating at a predetermined overcurrent value to raise to said predetermined value the threshold at which said electro-dynamic force is produced.

2. A current limiting circuit interrupter as recited in claim 1 wherein said magnetic drive device comprises a plurality of U-shaped magnetic plates.

3. A circuit interrupter as recited in claim 2 wherein said contact arm comprises a bridging contact arm supported for rectilinear motion and having a movable contact attached at each end, each of said movable contacts cooperating with corresponding stationary contacts to complete an electrical circuit therebetween when said bridging contact arm is in said first position, said circuit breaker comprising a pair of said magnetic drive devices, one at each end of said bridging contact arm.

4. A circuit interrupter as recited in claim 3 wherein said magnetic member comprises a thin mild steel plate.

* * * * *